US009745804B2

(12) United States Patent
Harper

(10) Patent No.: US 9,745,804 B2
(45) Date of Patent: Aug. 29, 2017

(54) CYLINDER ASSEMBLY FOR SNUBBING AND DRILLING APPLICATIONS

(71) Applicant: Tom M. Harper, Lafayette, LA (US)

(72) Inventor: Tom M. Harper, Lafayette, LA (US)

(73) Assignee: Full Flow Technologies, LLC, Lafayette, LA (US)

( * ) Notice: Subject to any disclaimer, the term of this patent is extended or adjusted under 35 U.S.C. 154(b) by 270 days.

(21) Appl. No.: 14/635,473

(22) Filed: Mar. 2, 2015

(65) Prior Publication Data

US 2016/0258232 A1 Sep. 8, 2016

(51) Int. Cl.

| | |
|---|---|
| ***E21B 19/00*** | (2006.01) |
| ***E21B 19/08*** | (2006.01) |
| ***E21B 19/086*** | (2006.01) |
| ***E21B 33/068*** | (2006.01) |

(52) U.S. Cl.

CPC ..... *E21B 19/086* (2013.01); *E21B 19/00* (2013.01); *E21B 33/068* (2013.01)

(58) Field of Classification Search

CPC ..... E21B 19/00; E21B 19/08; E21B 19/086; E21B 3/04; E21B 19/163

USPC ..... 74/41; 92/164

See application file for complete search history.

(56) References Cited

U.S. PATENT DOCUMENTS

| | | | | |
|---|---|---|---|---|
| 1,548,559 | A * | 8/1925 | Simpson | B66F 7/18 254/93 L |
| 2,504,406 | A | 4/1950 | Gandrup | |
| 2,623,257 | A | 12/1952 | Moon | |
| 3,096,075 | A * | 7/1963 | Brown | E21B 19/00 166/77.4 |
| 3,163,239 | A | 12/1964 | Vries et al. | |
| 3,419,113 | A | 12/1968 | Shelley | |
| 3,517,975 | A | 6/1970 | Lonngren et al. | |
| 3,797,570 | A | 3/1974 | Leutwyler | |
| 3,999,610 | A | 12/1976 | Sage et al. | |
| 4,251,176 | A | 2/1981 | Sizer et al. | |
| 4,324,161 | A | 4/1982 | Klancnik et al. | |
| 4,504,186 | A | 3/1985 | Richards | |
| 4,676,312 | A | 6/1987 | Mosing et al. | |
| 5,546,847 | A | 8/1996 | Rector et al. | |
| 5,913,490 | A | 6/1999 | McNeil et al. | |
| 6,158,516 | A | 12/2000 | Smith et al. | |
| 6,382,075 | B1 | 5/2002 | Chiaramonte et al. | |

(Continued)

OTHER PUBLICATIONS

I INA A, Axial/radial bearings YRT 1030 (Series YRT), Feb. 13, 2015.

(Continued)

*Primary Examiner* — Cathleen Hutchins

(57) ABSTRACT

A cylinder assembly for use as a cylinder comprises an upper outer tubular cylinder and a lower outer tubular cylinder and a stationary sealing ring retained between the upper and lower outer cylinders slideably receiving an inner tubular piston having upper and lower sealing flanges to create upper and lower fluid chambers. Pressurized fluid is selectively directed through flow conduits in the sealing ring into the upper or lower fluid chamber as desired to move the inner tubular piston upward and downward. The upper tubular cylinder supports an attached bearing table and travelling slips. A pipe guide for supporting a length of pipe is positioned in the lower outer tubular cylinder. A mechanism rotating a pipe and pipe string is also provided.

20 Claims, 7 Drawing Sheets

(56) References Cited

U.S. PATENT DOCUMENTS

| | | | |
|---|---|---|---|
| 6,386,284 | B1 | 5/2002 | Buck et al. |
| 6,827,493 | B2 | 12/2004 | Hooper |
| 7,117,948 | B2 | 10/2006 | Mazzella et al. |
| 7,578,352 | B2 | 8/2009 | Hallonquist et al. |
| 7,766,080 | B2 | 8/2010 | Khehra et al. |
| 8,328,429 | B2 | 12/2012 | Endres et al. |
| 8,794,847 | B2 | 8/2014 | Dondaine et al. |
| 2007/0084606 | A1 | 4/2007 | Ponville |
| 2008/0053661 | A1 | 3/2008 | Funk |
| 2009/0000788 | A1 | 1/2009 | Olsen et al. |
| 2010/0224357 | A1 | 9/2010 | Rodgers |
| 2010/0243268 | A1 | 9/2010 | Nguyen |
| 2011/0011598 | A1 | 1/2011 | Nguyen et al. |

OTHER PUBLICATIONS

I INA A, Axial/radial bearings YRT 650 (Series YRT), Feb. 13, 2015.

Bruel & Kjaer, Slip Tables & Combo Systems, LDS Combo brochure, UK 2008 BG 1726.

Rotary and Handling Tools Catalog, 2013 Land and Offshore, National Oilwell Varco, 2013.

* cited by examiner

CYLINDER ASSEMBLY FOR SNUBBING AND DRILLING APPLICATIONS

FIELD OF THE INVENTION

This invention relates to offshore drilling and production of oil and gas. More specifically, the invention relates to an improved hydraulic cylinder assembly for snubbing and drilling applications.

BACKGROUND

Running a pipe segment into or out of a wellbore during the drilling, completion, or production phases of oil and gas well operations often requires adding or removing the pipe segment when the wellbore is under pressure. Typically this wellbore pressure is retained by pressure control equipment having resilient internal seals that seal the wellbore opening around the pipe string. Running pipe into the wellbore under pressure is called snubbing. During snubbing significant downward force on the pipe is often required in order to urge the pipe through the internal seals of the pressure control equipment used to retain the wellbore pressure.

Snubbing typically requires special equipment called snubbing units. A typical snubbing unit has a traveling frame that supports a traveling pipe gripping device such as a traveling slip-type spider and that moves upward and downward between upper and lower stationary frames. The upper stationary frame, called a work basket, has railing and decking and serves as a platform for workers. The lower stationary frame is positioned around the wellbore pressure control equipment such as a stack of blow out preventers (BOP stack) with retractable internal rams that seal the opening into the wellbore. The lower stationary frame has a stationary spider used to hold and support the wellbore pipe string.

The traveling frame is attached to and supported upon the extendable and retractable pistons of large hydraulic jacks or cylinders mounted between the lower stationary frame and the traveling frame. Extension and retraction of the pistons of the hydraulic cylinders moves the traveling frame vertically upward and downward with respect to the lower stationary frame. This upward and downward movement allows the traveling frame, with the traveling spider, to be extended upward through the opening in the workbasket and downward to a position approaching the lower stationary frame and stationary pipe gripping device. The traveling frame and hydraulic cylinder combination is sometimes called a snubbing jack and the cylinder of the snubbing jack can be sized as desired to produce a desired snubbing load or force.

When a new pipe segment is added to a wellbore pipe string during snubbing, the lower stationary frame is positioned around the pressure control equipment of the wellbore with the stationary spider in vertical alignment with the wellbore and with the sealed opening of the pressure control equipment. The wellbore pipe string is supported by the stationary spider on the stationary frame. The traveling frame is extended upward from the lower stationary frame by extension of the pistons of the hydraulic cylinders to extend into the opening of the workbasket.

A new pipe segment is then positioned to extend vertically downward from the workbasket, gripped by the traveling spider of the traveling frame, and held in position over the wellbore pipe string. The pistons of the hydraulic cylinders supporting the traveling frame are then retracted to lower the traveling frame and the new pipe segment toward the wellbore pipe string for connection to the wellbore pipe string. A top drive, rotary or similar rotating equipment is used to rotate the new pipe segment to connect it to the wellbore pipe string. The tubular pistons are then further retracted to push or snub the new pipe segment through the internal seals of the pressure control equipment to advance the pipe string into the wellbore. This process is reversed when a pipe is removed from the wellbore.

Because snubbing is done under wellbore pressure, the weight of pipe string in the wellbore may be less than the force generated on the pipe string by the wellbore pressure. In that situation the wellbore pressure may push the wellbore pipe string upward out of the wellbore. To prevent the pipe string from being ejected from the wellbore due to the wellbore pressure, the traveling and stationary frames and their associated pipe gripping devices must be positioned to maintain firm control of both the wellbore pipe string and the pipe segment being added.

One problem associated with typical snubbing units is that the pipe being snubbed is unsupported along its length when the pistons of the hydraulic cylinders are retracted to force the pipe string downward into the wellbore against the upward wellbore pressure. The compressive forces placed on the unsupported pipe during snubbing increases the risk that the pipe will buckle as it is pushed through the internal seals of the pressure control equipment. To reduce the risk of pipe buckling as the traveling frame is lowered to snub the pipe string into the wellbore, only relatively short segments of pipe are inserted on each cycle of the traveling frame. This increase the time and costs associated with a typical snubbing operation.

SUMMARY OF THE INVENTION

The invention provides a cylinder assembly for snubbing operations that allows the pipe being snubbed to be supported along its length during the entire snubbing operation. This support reduces the risk of pipe buckling and allows longer segments of pipe to be inserted or snubbed during snubbing operations. This in turn reduces both the time required to complete the snubbing operation and the risks associated with buckled pipe segments.

The cylinder assembly has an upper outer cylinder with base end and top end connection flanges; a lower outer cylinder with base end and top end connection flanges; and a cylindrical inner tubular piston slideably mounted through a tubular stationary sealing ring. The inner tubular piston has an upward end fitted with an upper radially extending piston seal and a lower end with a removable lower radially extending piston seal that is releasably mounted to the inner tubular piston by a collet and lock nut, or other releasable attachment mechanism. The lower end of the inner tubular piston may have a beveled or tapered end around its periphery to allow for installation of the stationary sealing ring.

At least one upper cylinder fluid port is provided in the lower connection flange of the upper outer cylinder and at least one lower outer cylinder fluid port is provided in the upper connection flange of the lower outer cylinder. These fluid ports provide fluid access to upper and lower fluid conduits, respectively, that extend through the stationary sealing ring. The flange fluid ports and stationary sealing ring fluid conduits allow hydraulic fluid to be delivered to either the upper outer cylinder or lower outer cylinder to move the inner tubular piston upward or downward as desired by fluid pressure on the upper or lower radially extending piston seals.

The cylinder assembly is assembled by fitting the lower end of the inner tubular piston through the stationary sealing ring so that the stationary sealing ring extends radially around the inner tubular piston and inserting the upper end of the inner tubular piston into the base of upper outer cylinder. The stationary sealing ring is then inserted or squeezed into the base of the upper outer cylinder. The removable lower radially extending piston seal is then mounted to the lower end of the inner tubular piston by the collet and lock nut combination. A suitable threaded connection or other suitable connecting mechanisms or combinations of connecting mechanisms may be used in place of a collet and lock nut combination to secure the removable lower radially extending piston seal to the inner tubular piston. The stationary sealing ring is then inserted or squeezed into the top of the lower cylinder. The upper and lower outer cylinders are then attached together by their adjoining connection flanges. When the cylinder assembly is properly assembled the stationary sealing ring will remain in place between the upper and lower outer cylinders.

The upper and lower radially extending piston seals of the inner tubular piston provide a fluid seal at the inner wall of the upper and lower cylinders, respectively, to prevent the loss of hydraulic fluid. Similarly, the outer radial surface of the stationary sealing ring provides a fluid seal at the inner wall of the upper and lower cylinders and the inner radial surface of the stationary sealing ring provides a fluid seal at the inner tubular piston to prevent the loss of hydraulic fluid during operation. The fluid seal provided by upper and lower radially extending piston seals and the stationary sealing ring creates an upper annular fluid chamber between the upper radially extending piston seal and the stationary sealing ring and a lower annular fluid chamber between the stationary sealing ring and the lower radially extending piston seal.

Hydraulic fluid from a fluid reservoir is supplied into the upper annular fluid chamber through the upper fluid conduit in the stationary sealing ring and the upper cylinder fluid port in the lower connection flange of the upper outer cylinder and into the lower annular fluid chamber through the lower fluid conduit in the stationary sealing ring and the lower cylinder fluid port in the upper connection flange of the lower outer cylinder as desired by way of a directional valve and pump mechanism. When high pressure hydraulic fluid is forced into the upper annular fluid chamber, the inner tubular piston will move upward and the hydraulic fluid in the lower annular fluid chamber will be forced out of the lower outer cylinder through the lower fluid conduit in the stationary sealing ring and returned to the fluid reservoir through the lower cylinder fluid port. When high pressure hydraulic fluid is supplied to the lower annular fluid chamber, the inner tubular piston will move downward and the hydraulic fluid in the upper outer cylinder will be forced out of the upper annular fluid chamber through the upper fluid conduit in the stationary sealing ring and returned to the fluid reservoir through the upper cylinder fluid port. A pipe guide inserted through the base of lower outer cylinder supports the pipe being snubbed along its length during this reciprocal upward and downward movement of the inner tubular piston.

These drawings omit features that are well known and do not bear upon points of novelty in the interest of descriptive clarity. Such omitted features may include threaded junctures, weld lines, bolted fasteners, pins and brazed junctures.

DESCRIPTION OF THE EMBODIMENT

Figure 1:
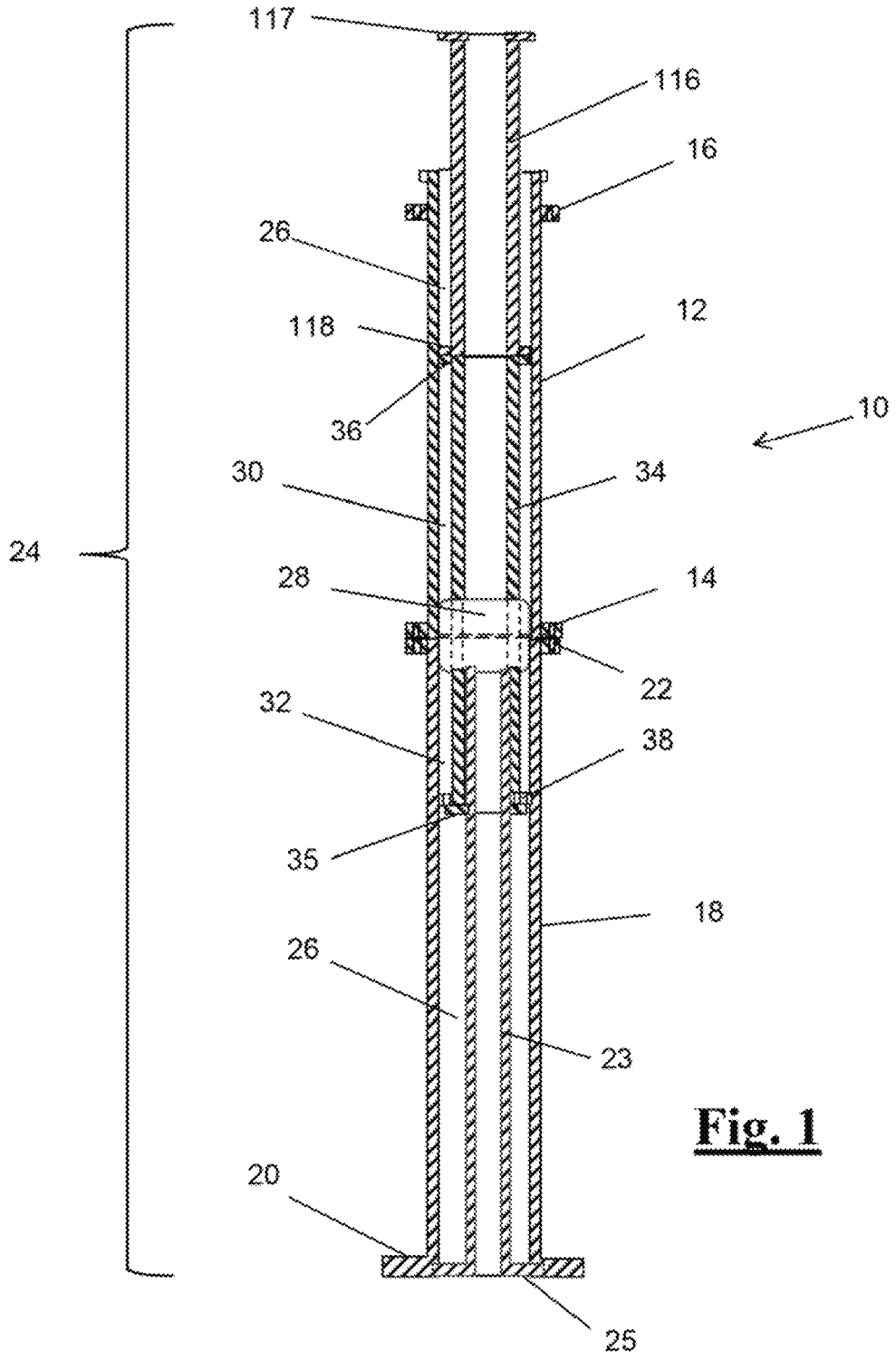
FIG. 1 is a schematic view of the cylinder assembly described herein.
Figure 2:
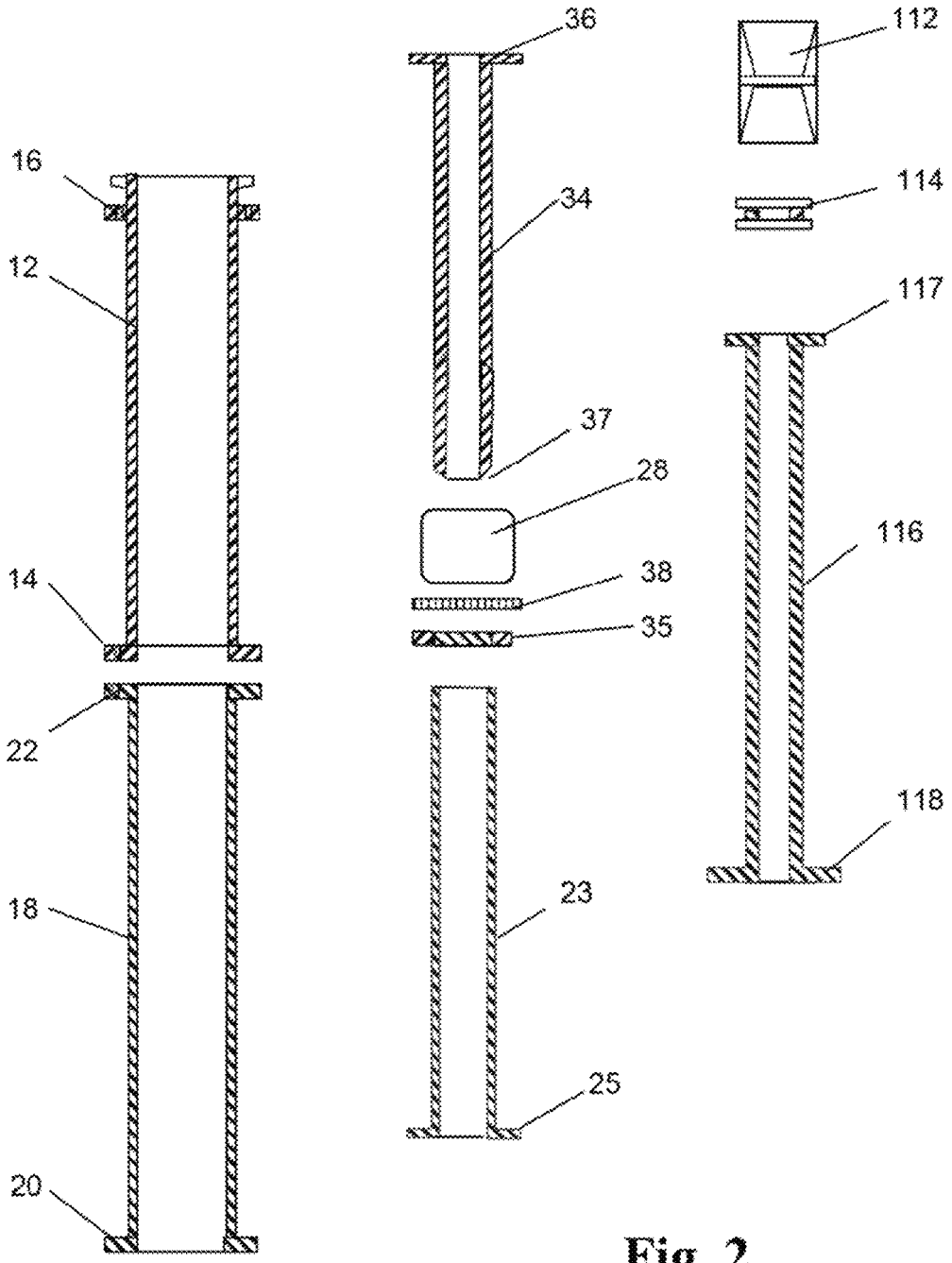
FIG. 2 illustrates the components of the cylinder assembly shown in FIG. 1.

FIG. 1 shows the improved cylinder assembly 10 for use in connection with snubbing pipe. FIG. 2 shows the components of cylinder assembly 10 and its accessory attachments. Cylinder assembly 10 is comprised of a longitudinally extending outer tubular cylindrical housing 24 having a central bore 26, a tubular stationary sealing ring 28 mounted within the central bore 26 of the housing 24, and a cylindrical inner tubular piston 34 slideably mounted through the stationary sealing ring 28.

While housing 24 may be a single tubular cylinder with a top end connection flange 16 and base end connection flange 20, preferably housing 24 will be comprised of an upper outer tubular cylinder 12, having top end connection flange 16 and a lower end connection flange 14, and a lower tubular cylinder 18, having base end connection flange 20 and top end connection flange 22. The lower end connection flange 14 of upper tubular cylinder 12 is bolted to top end connection flange 22 of lower cylinder 18 to create the longitudinally extending outer tubular cylinder housing 24 having a central bore 26 as shown in the drawings.

The cylindrical inner tubular piston 34 has an upper radially extending piston seal flange 36 and a detachable lower radially extending piston seal flange 38 and is slidably positionable through stationary sealing ring 28 that is positioned within the central bore 26 of the housing 24. The lower piston seal flange 38 is preferably detachably mounted to the inner piston 34 by attachment threads or by a collet that is secured in place by a lock nut 35. The external periphery around the lower end or base 37 of the inner tubular piston 34 may be beveled or undercut to facilitate insertion of the tubular piston 37 into a stationary sealing ring 28. The radially extending upper piston seal flange 36 and lower piston seal flange 38 is configured for bolted attachment of pipe subs and fittings.

The tubular stationary sealing ring 28 is sized to fit tightly around inner tubular piston 34 as inner tubular piston 34 is slideably positioned with respect to stationary sealing ring 28 and to fit tightly within the central bore 26 of the outer tubular cylinder housing 24 in order to seal the annulus created between the inner tubular piston 34 and the tubular housing 24. The sealing ring 28 and the inner tubular piston 34 divides the central bore 26 of the outer tubular cylinder housing 24 to create upper annular fluid chamber 30 in the upper tubular cylinder 12 between upper piston seal flange 36 and sealing ring 28 and a lower annular fluid chamber 32 in the lower tubular cylinder 18 between lower piston seal flange 38 and sealing ring 28.

The cylinder assembly 10 will preferably have a tubular pipe guide 23 positioned within the lower outer tubular cylinder 18 of tubular housing 24. Pipe guide 23 is retained in tubular cylinder 18 by pipe guide flange 25 fitted on flange 20 of outer cylinder 18 and preferably extends through inner tubular piston 34 to engagement with the sealing ring 28. Pipe guide 23 may also extend above sealing ring 28.

An optional spacer spool 116 having an upper attachment flange 117 and a lower attachment flange 118 is also provided. The spacer 118 may be attached by its lower attachment flange 118 to upper piston seal flange 36 to extend the reach of tubular piston 34. A rotatable bearing table 114 may be attached to the upper attachment flange 117 of spacer spool which is in turn may be attached to traveling slips 112. If spacer spool 116 is not utilized bearing table 114 may be attached directly to upper piston seal flange 36.

Figure 3:
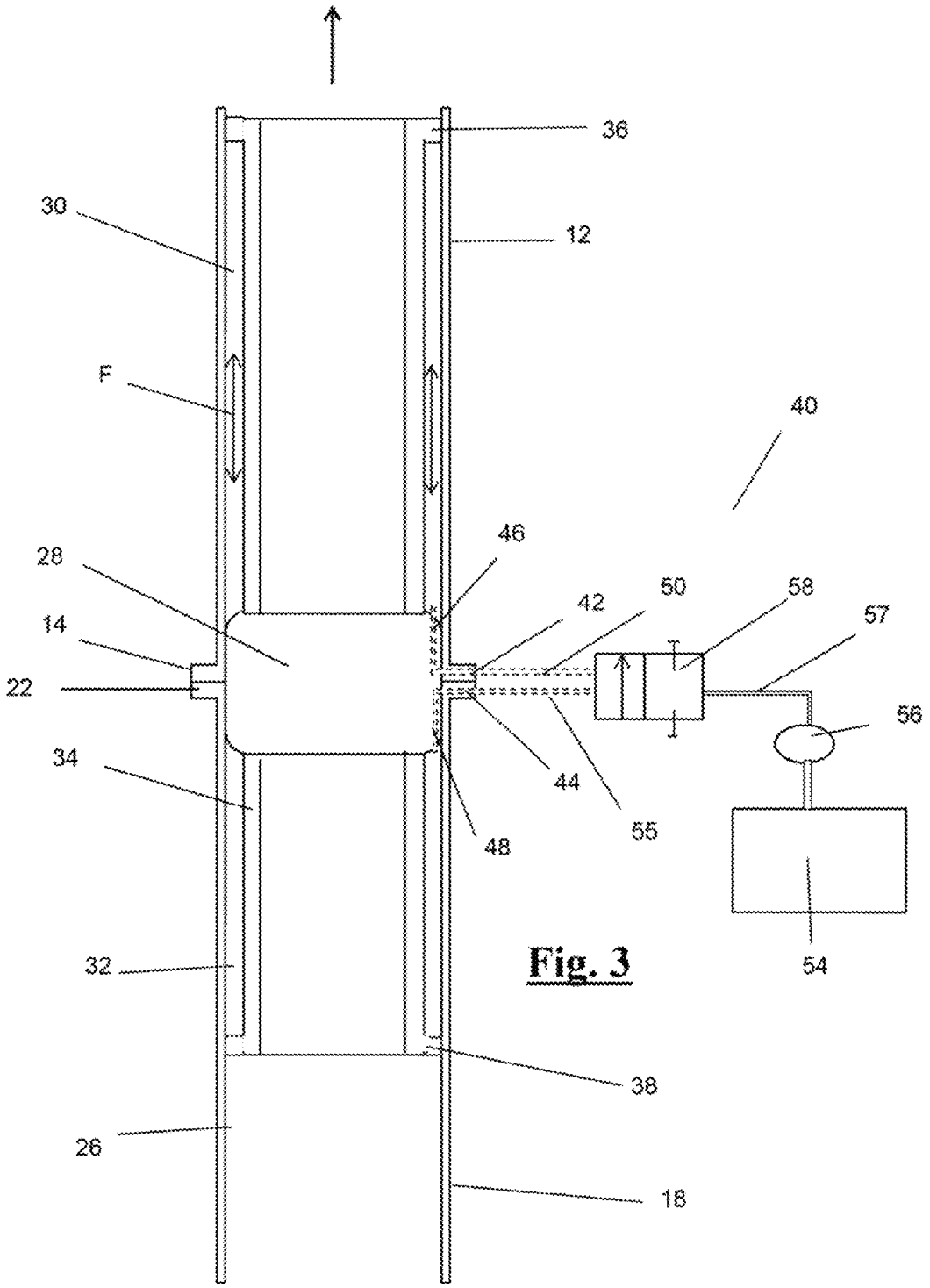
FIG. 3 is a schematic view of the tubular stationary sealing ring and hydraulic system of the cylinder assembly shown in FIG. 1 with the tubular piston in the upward position.
Figure 4:
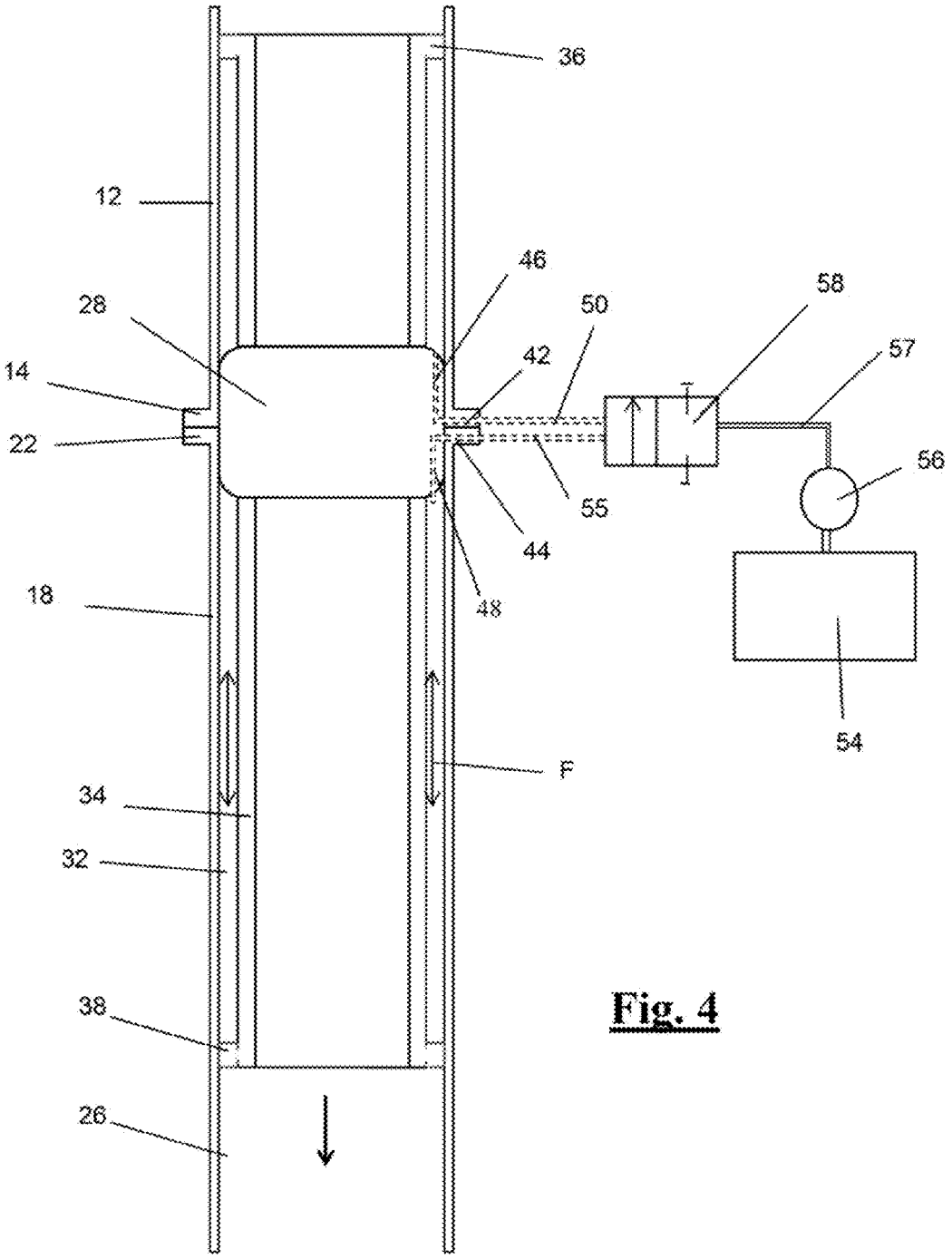
FIG. 4 is a schematic view of the tubular stationary sealing ring and hydraulic system of the cylinder assembly shown in FIG. 1 with the tubular piston in the downward position.

FIG. 3 and FIG. 4 show schematic views of the movement of the inner tubular piston 34 with respect to the stationary sealing ring 28 within the central bore 26 of cylinder assembly 10 by operation of the hydraulic system 40. Pipe guide 23 and other fittings are omitted for clarity. As shown in FIG. 3 and FIG. 4, the hydraulic system 40 includes at least one upper cylinder fluid port 42 in the base end connection flange 14 of upper cylinder 12 and at least one lower cylinder fluid port 44 in top end connection flange 22 of lower tubular cylinder 18. Fluid port 42 is in fluid communication with upper fluid conduit 46 that extends through the stationary sealing ring 28 into the upper fluid chamber 30. Fluid port 44 is in fluid communication with lower conduit 48 that extends through the stationary sealing ring 28 into the lower fluid chamber 32.

Hydraulic system 40 also includes a fluid reservoir 54 that delivers fluid F, by way of a pump mechanism 56, supply line 57, and directional valve 58, to an upper hydraulic line 50 in communication with fluid port 42 and fluid conduit 46 and a lower hydraulic line 55 in communication with fluid port 44 and fluid conduit 48. The fluid ports 42 and 44 and fluid conduits 46, 48 allow hydraulic fluid to be delivered to either the upper fluid chamber 30 or the lower fluid chamber 32 of the central bore 26 of the outer tubular cylinder housing 24, respectively.

Figure 5:
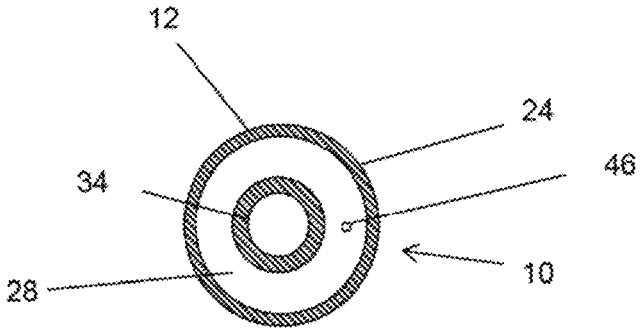
FIG. 5 is a top view of the stationary sealing ring as seen from a top cross-section view through the upper outer cylinder of the cylinder assembly of FIG. 1.

FIG. 5 is a top view of the sealing ring 28 as seen from a top cross-section view of the cylinder assembly 10 cut through the upper fluid chamber 30 created in the central bore 26 of upper outer cylinder 12 of cylinder housing 24. Fluid conduit 46 extends through the stationary sealing ring 28 for fluid communication with chamber 30. The stationary sealing ring 28 provides a fluid seal to seal the annulus between the inner tubular piston 34 and the upper outer cylinder 12 that forms part of the cylinder housing 24 of the cylinder assembly 10. Multiple fluid conduits 46 with associated fluid ports 42 and hydraulic lines 50 may be provided.

Figure 6:
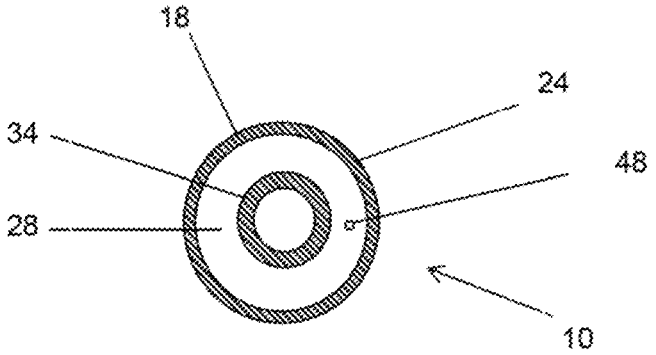
FIG. 6 is a bottom view of the stationary sealing ring as seen from a bottom cross-section view through the lower outer cylinder of the cylinder assembly of FIG. 1.

Similarly, FIG. 6 shows a bottom view of the sealing ring 28 as seen from a bottom cross-section view of the cylinder assembly 10 cut through the lower fluid chamber 32 created in the central bore 26 of lower outer cylinder 18 of cylinder housing 24. Fluid conduit 48 extends through the stationary sealing ring 28 for fluid communication with chamber 32. The stationary sealing ring 28 provides a fluid seal to seal the annulus between the inner tubular piston 34 and the lower outer cylinder 18 that forms part of the cylinder housing 24 of the cylinder assembly 10. Multiple fluid conduits 48 with associated fluid ports 44 and hydraulic lines 55 may be provided.

Hydraulic fluid F from fluid reservoir 54 is supplied through fluid lines 50 and 55 to the upper fluid chamber 30 or the lower fluid chamber 32, respectively, as desired by way of pump mechanism 56, supply line 57, and a directional valve 58. When high pressure hydraulic fluid is forced into the upper fluid chamber 30, the inner tubular piston 34 will move upwards in response to the fluid pressure and the hydraulic fluid in the lower fluid chamber 32 will be forced out of fluid chamber 32 through fluid conduit 48 and fluid port 44 and returned to the fluid reservoir 54 by lower hydraulic line 55. When high pressure hydraulic fluid F is forced into lower fluid chamber 32, the inner tubular piston 34 will move downward and the hydraulic fluid in the upper fluid chamber 30 will be forced out of the upper fluid chamber 30 through fluid conduit 46 and fluid port 42 and returned to the fluid reservoir 54 by upper hydraulic line 50.

Multiple fluid ports 42 and 44, fluid conduits 46, 48, and hydraulic lines 50, 54 may be provided as part of the hydraulic system 40 to allow hydraulic fluid to be delivered to either the upper fluid chamber 30 or the lower fluid chamber 32. If desired multiple hydraulic lines 50, 55 may be interconnected by a manifold and valve system incorporated into the hydraulic system 40 as may be required to enhance the upward and downward manipulation of the inner tubular piston 34 within the housing 24 of the cylinder assembly 10.

Figure 7:
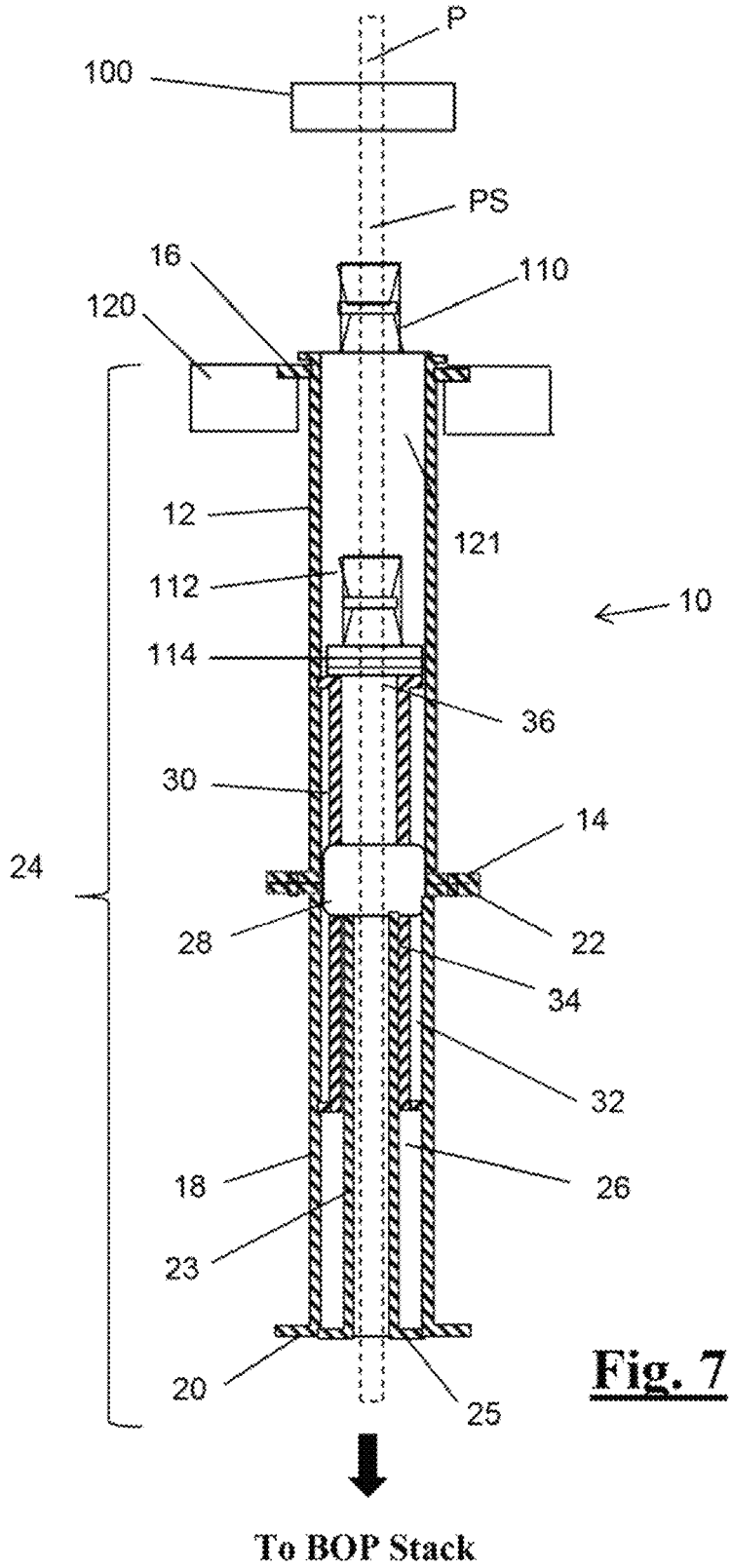
FIG. 7 is a schematic view of the cylinder assembly of FIG. 1 configured for drilling for use with a top drive of a drilling rig.

FIG. 7 shows a schematic diagram of the cylinder assembly 10 incorporated for use with an oil and gas well drilling rig having a top drive 100. Top drive 100 provides rotational torque to the pipe string for milling and drilling operations and transfers the load of the pipe or drill string PS to the bit. The top drive 100 is mounted over an opening 121 in the rig floor 120 that is positioned over a wellbore containing a pipe string PS typically running through a stack of rams and blow out preventers referred to as the BOP stack.

For use in a drilling operation an assembled cylinder assembly 10 is mounted to extend below the floor 120 in opening 121 by radial flange 16 of outer tubular cylinder 12. Stationary slips 110 are mounted on the floor 120 above the upper cylinder 12. Travelling slips 112 are attached to bearing table 114 which is attached flange to seal flange 36 at the upper end of the inner tubular piston 34 within the central bore 26 of cylinders 12 and 18 that form the outer cylinder housing 24.

When moving pipe P into or out of the wellbore, the directional valve 58 of the hydraulic system 40 is used to regulate the flow of hydraulic fluid F into and out of the upper fluid chamber 30 and the lower fluid chamber 32 of the central bore 26 of the central housing 24 as desired to manipulate the inner tubular piston 34 as described and shown in FIGS. 3 and 4. Depending upon the direction fluid flow from the hydraulic system 40, inner tubular piston 34 travels upward and downward within the central bore 26 of the central housing 24 to move the attached bearing table 114 and the traveling slips 112 upward and downward within the housing 24.

As shown in FIG. 7, wellbore pipe string PS having pipe attachment threads extends through the inner piston 34 of cylinder assembly 10 and is supported by the stationary slips 110 above the rig floor 120. To add a threaded pipe P to the pipe string PS, the pipe string PS is held in position by the stationary slips 110, traveling slips 112 are released, and piston 34 is moved upward by sliding through sealing ring 28 by fluid movement into upper fluid chamber 30. The stationary slips 110 hold the pipe string PS while pipe P is threadedly attached to the pipe string PS by rotation of pipe P by top drive 100 or by an associated spinner. While pipe P, now part of the pipe string PS, is still attached for rotation by the top drive 100, the travelling slips 112 are manipulated to set the slips and grip the pipe string PS and the stationary slips 110 are then manipulated to release pipe P now part of pipe string PS.

The piston 34 of cylinder assembly 10 is then moved downward by fluid movement into lower fluid chamber 32 while the pipe string PS is held by the travelling slips 112 as the pipe string PS is rotated on the bearing table 114 by the top drive 100 to advance the wellbore. Mounting the travelling slips 112 on the bearing table 114 allows the pipe string PS to be set in or gripped by the stationary slips while the traveling slips 112 travel upward to grip the pipe string PS again without having to stop the rotation of the pipe string PS by the top drive 100. This allows an entire joint of pipe P to be added to the pipe string PS and moved into the wellbore without stopping the rotation of the pipe string.

Figure 8:
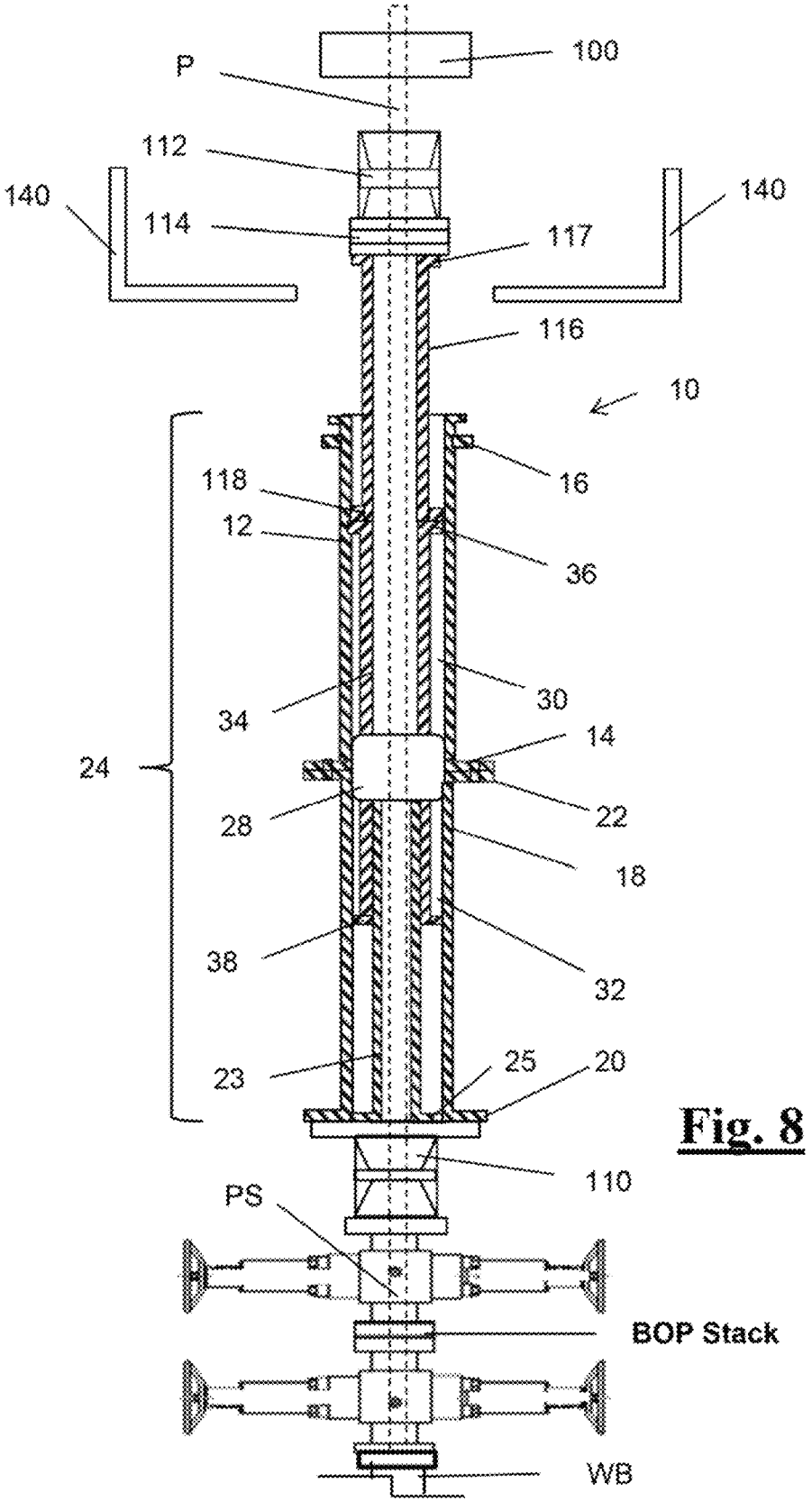
FIG. 8 is a schematic view of the cylinder assembly of FIG. 1 configured for snubbing operations.

FIG. 8 shows the cylinder assembly 10 configured for snubbing and hydraulic workover operations. In this snubbing configuration the housing 24 of cylinder assembly 10 is attached by means of lower flange 20 to stationary slips 110 mounted on the BOP stack. Since the piston 34 cannot extend beyond the housing 24 and the diameter of housing 24 is too small to allow the rotary 114 and slips 112 to travel inside the housing, cylindrical spacer spool 116 is used to attach the rotary table 114 and travelling slips 112 to the piston 34 by means attachment flange 118 of spool 116 and seal flange 36 at the top of piston 34. If the cylinder were larger such as in drilling applications, the rotary 114 and traveling slips 112 could be mounted directly to the piston 34 and would travel in the housing itself as in FIG. 7. The spool 116 is modified to have a thicker tubing wall to prevent buckling of the spool 116 due to column loading or shearing from the high loading required for snubbing operations.

The bearing table 114 is attached to the upper flange 117 of spool 116 which in turn supports traveling slips 112 (snubs and heavies). To reduce or prevent the incidence of bucking of pipe P in the lower cylinder 18 and associated damage to the pipe and snubbing equipment and the risk of injury to well personnel when piston 34 is retracted into the lower cylinder 18, pipe guide 23 is inserted into lower cylinder 18 at its base. Pipe guide 23 provides support to the pipe P along the length of the lower cylinder 18 as the pipe P is pushed or snubbed under pressure into the wellbore WB after it is attached to the pipe string PS.

During snubbing stationary slips 110 hold pipe string PS while the bearing table 114 and traveling slips 112 mounted on spool 116 are moved upwardly toward the work basket 140 suspended above the BOP stack by fluid movement into upper fluid chamber 30. The traveling slips 112 are manipulated to set and grip pipe P and the stationary slips 110. Piston 34 of cylinder assembly 10, with spool 116, rotary table 114, traveling slips 112 and pipe P, is then moved downward by fluid movement into lower fluid chamber 32 to engage pipe P with the pipe string PS. Top drive 100 or other pipe spinner is then used to rotate pipe P on rotary table 114 to threadably attach pipe P to pipe string PS.

When pipe P is threadably attached to pipe string PS, stationary slips 110 are manipulated to release the grip of the pipe string PS and piston 34 is then move further downward by introduction of fluid into lower fluid chamber 32 to force or push pipe P, now attached to pipe string PS, through the BOP stack to snub pipe string PS into the wellbore. The stationary slips 110 are then set to hold the pipe string PS again and the piston 34 with spool 116 is again moved upward toward the work basket 140 by fluid movement into upper fluid chamber 30 while the pipe string PS is held in position by the stationary slips 110. This upward movement will allow another pipe P to be gripped by the travelling slips 112 and lowered for attachment to pipe string PS and snubbed through the BOP stack as described above.

The top drive 100 is only used to supply rotary torque to the pipe P and pipe string PS. It need not be sized to support the pipe string. This means that only a powered swivel above the work basket is required to perform a drilling or milling operation. The top drive powered swivel 100 will carry none of the weight of the pipe string.

From the foregoing it can be appreciated that because pipe P is fully supported along its length buckling is no longer a factor in load calculations. The load capacity of the cylinder assembly 10 is then equal to the annular area in the central bore 26 between the central housing 24 and the inner tubular piston 34 multiplied by the fluid pressure applied in the upper fluid chamber 30 or the lower fluid chamber 32 as the case may be. Since the annular areas around the inner tubular piston 34 in the upper fluid chamber 30 and the lower fluid chamber 32 of the central bore 26 above and below the stationary sealing ring 28 are the same, the same force can be applied equally up or down.

Because of the unique design of the cylinder assembly 10, the entire load of the work string or drill string is supported by the cylinder assembly 10. This means that only a powered swivel above the work basket is required when performing milling or drilling operations with the cylinder assembly 10.

The stationary slips 110 and the traveling slips 112 may be comprised of a plurality of powered wedge-shaped slips that move inward and outward along a tapered slip carrier such as a tapered bowl to grip and release the pipe string PS in response to movement of linear actuators. Such slips may be manipulated remotely to grip and release a pipe string by operation of liner actuators such as hydraulic or pneumatic cylinders having extendable and retractable pistons. The stationary slips 110 and the traveling slips 112 will be comprised of heavy slips to bear the weight of the pipe string PS and inverted slips to grip the pipe string PS when the inner tubular piston 34 is moved downward in the cylinder housing to push the pipe through the BOP stack under pressure during snubbing. Examples of suitable slips would be similar to those described in U.S. Pat. No. 6,640,939 to Dave A Buck, U.S. Pat. No. 3,999,610 to Vernon Sage, et al., U.S. Pat. No. 3,797,570 to Kurt Leutwyler, U.S. Pat. No. 4,119,297 to Albert W. Gunther, or in U.S. Pat. No. 7,117,948 B2 to Mark Mazzella, et al.

The bearing table 114 may be any bearing table having a central bore that supports the weight of the traveling slips 112 and the pipe string PS. A rotary table with a drive mechanism for turning the rotary may be used as a bearing table 114. In such a case the rotary table may be used to rotate pipe P rather than a top drive or other rotating device. The bearing table 114 may also be a non-powered rotary table because a drive system of the bearing table 114 is not needed when the top drive 100 is used to rotate the pipe P. Bearing tables suitable for use as bearing table 114 includes the YRT Series of rotary bearings manufactured by Schaeffler Technologies AG & Co. KG, Schaeffler AG Industriestraβe 1-3, 91074 Herzogenaurach, Germany, http://www.schaeffler.com, when placed in a suitable housing sized to support the anticipated pipe loadings, the rotary stage described in International Pub. No. WO 03/026844 A2, or the bearing assembly described in U.S. Pat. No. 8,794,847 B2 to Herve Dondaine, et al.

The cylinder assembly 10 may also be used as a motion or heave compensator to decrease the undesirable effects of the relative motion between two connected objects such as the rig floor 120 of a floating drilling vessel or platform and subsea BOP stack. These negative effects include the changes in force and stress in a connecting riser or drill pipe or the forces and stress associated with repetitive starting and stopping of forces on the connected objects.

For use as a motion or heave compensator, stationary slips 110, traveling slips 112, and rotary table 114 shown in FIG. 7 and FIG. 8 are not utilized when making up cylinder assembly 10. Upper flange 117 of spool 116 is connected to rig floor 120 of a floating drilling rig or platform in a manner similar to that shown for flange 16 of upper outer tubular cylinder 12 in FIG. 7. The cylinder assembly 10 is then provided with a flanged riser pipe extending between the cylinder assembly 10 and the BOP stack positioned above the sea floor. The riser pipe has a top riser flange attached to the lower piston seal flange 38 of piston 34 and a bottom riser flange attached to a connection flange at the top of the BOP stack.

When the cylinder assembly 10 is so connected, the housing 24 of cylinder assembly 10 comprised of upper outer tubular cylinder 12 and lower outer tubular cylinder 18 remains stationary with respect to rig floor 120 and rises and falls with the rig floor in response to wave and sea motion imparted to the floating drilling rig or platform. The riser pipe and the attached piston 34 remain stationary to the BOP stack at the sea floor. The hydraulic fluid is placed in the upper annular fluid chamber 30 in the upper tubular cylinder 12 between upper piston seal flange 36 and sealing ring 28 by means of the hydraulic system 40 so that sufficient fluid pressure is maintained to hold the weight of the riser. This configuration will dampen the forces and stress applied to the BOP stack and the riser pipe as the rig heaves from associated movement due to sea and wave action.

Changes may be made in the form, construction and arrangement of the parts of cylinder assembly 10 and its accessories without departing from the spirit and scope of the invention or sacrificing any of the invention's material advantages. The description and drawings provide only exemplary embodiments and methods of use and the invention can be practiced by other than the described embodiments, which are presented only for illustration and not limitation.

I claim:

1. A wellbore snubbing cylinder assembly comprising:

(a) an upper outer tubular cylinder having a top end and a base end;

(b) a lower outer tubular cylinder having a top end and a lower end;

(c) a stationary piston sealing ring retained between said upper and said lower outer tubular cylinders, said piston sealing ring having an upper fluid conduit in fluid communication with said upper tubular cylinder and a lower fluid conduit in fluid communication with said lower tubular cylinder;

(d) an inner tubular piston slideably positioned within said piston sealing ring, said tubular piston have an upper end and a lower end; and (e) fluid lines to said upper fluid conduit and said lower fluid conduit of said piston sealing ring whereby fluid flow may be selectively directed.

2. The cylinder assembly as recited in claim 1 further comprising:

(a) a base end connection flange at the base of said upper outer tubular cylinder;

(b) a top end connection flange at said top end of said lower outer tubular cylinder, said base end connection flange and said top end connecting flange connecting said upper tubular cylinder to said lower tubular cylinder;

(c) said a base end connection flange having an upper fluid port in fluid communication with said upper fluid conduit of said piston sealing ring; and (d) said top end connection flange having a lower fluid port in fluid communication with said lower fluid conduit of said piston sealing ring.

3. The cylinder assembly as recited in claim 2 wherein said inner tubular piston has a radially extending seal at said piston upper end sealing the annulus between said upper tubular cylinder and said inner tubular piston and a radially extending seal at said piston lower end sealing the annulus between said lower tubular cylinder and said inner tubular piston.

4. The cylinder assembly as recited in claim 3 wherein said radially extending seal at said lower end of said inner tubular piston is detachably mounted to said inner tubular piston.

5. The cylinder assembly as recited in claim 4 further comprising:

(a) a pump providing fluid to said fluid lines; and (b) a directional valve whereby fluid flow to said upper fluid port and said lower fluid port may be selectively directed thereby moving said inner tubular piston upward and downward within said upper tubular cylinder and said lower tubular cylinder as desired.

6. The cylinder assembly as recited in claim 5 wherein said radially extending seal at said piston upper end includes an attachment flange.

7. A cylinder assembly for snubbing comprising:

(a) an upper outer tubular cylinder having a top end and a base end;

(b) a lower outer tubular cylinder having a top end and a lower end;

(c) a stationary piston sealing ring retained between said upper and said lower outer tubular cylinders, said piston sealing ring having an upper fluid conduit in fluid communication with said upper tubular cylinder and a lower fluid conduit in fluid communication with said lower tubular cylinder;

(d) an inner tubular piston slideably positioned within said piston sealing ring, said tubular piston have an upper end and a lower end;

(e) fluid lines to said upper fluid conduit and said lower fluid conduit of said piston sealing ring whereby fluid flow may be selectively directed;

(f) a base end connection flange at the base of said upper outer tubular cylinder;

(g) a top end connection flange at said top end of said lower outer tubular cylinder, said base end connection flange and said top end connecting flange connecting said upper tubular cylinder to said lower tubular cylinder;

(h) said base end connection flange having an upper fluid port in fluid communication with said upper fluid conduit of said piston sealing ring;

(i) said top end connection flange having a lower fluid port in fluid communication with said lower fluid conduit of said piston sealing ring;

(i) wherein said inner tubular piston has a radially extending seal at said piston upper end sealing the annulus between said upper tubular cylinder and said inner tubular piston and a radially extending seal at said piston lower end sealing the annulus between said lower tubular cylinder and said inner tubular piston;

(k) wherein said radially extending seal at said lower end of said inner tubular piston is detachably mounted to said inner tubular piston;

(l) a pump providing fluid to said fluid lines;

(m) a directional valve whereby fluid flow to said upper fluid port and said lower fluid port may be selectively directed thereby moving said inner tubular piston upward and downward within said upper tubular cylinder and said lower tubular cylinder as desired;

(n) wherein said radially extending seal at said piston upper end includes an attachment flange; and (o) wherein said upper outer tubular cylinder is mounted to a drilling rig floor to extend downward from an opening in said floor, said cylinder further comprising:

(p) stationary slips mounted to said top end of said upper outer tubular cylinder;

(q) a bearing table attached to said attachment flange at said upper end of said inner tubular piston; and (r) travelling slips attached to said bearing table whereby a pipe extending through said inner tubular piston may be selectively gripped and released.

8. The cylinder assembly as recited in claim 7 further comprising a top drive whereby said pipe may be rotated.

9. The cylinder assembly as recited in claim 8 further comprising a tubular pipe guide positioned to extend upward from within said lower outer tubular cylinder.

10. A wellbore snubbing cylinder assembly comprising:

(a) an outer tubular housing having a top end and a base end;

(b) a stationary piston sealing ring retained within said outer tubular housing between top end and said base end;

(c) an inner tubular piston slideably positioned within said piston sealing ring, said tubular piston have an upper sealing flange creating an upper fluid chamber in said outer tubular housing between said upper sealing flange and said stationary piston and a lower fluid chamber between said lower sealing flange and said stationary piston;

(d) an upper fluid conduit in said stationary piston sealing ring in fluid communication with said upper fluid chamber and a lower fluid conduit in said stationary piston in fluid communication with said lower fluid chamber; and (e) a first fluid line in communication with said upper fluid conduit and a second fluid line in communication with said lower fluid conduit whereby pressurized fluid may be selectively directed.

11. The cylinder assembly as recited in claim 10 further comprising:

(a) a pump providing fluid to said first and said second fluid lines; and (b) a directional valve whereby fluid flow to said first and said second fluid lines may be selectively directed to said upper and lower fluid conduits whereby said fluid moves said inner tubular piston upward and downward within said outer tubular housing as desired.

12. A cylinder assembly comprising:

(a) an outer tubular housing having a top end and a base end;

(b) a stationary piston sealing ring retained within said outer tubular housing between top end and said base end;

(c) an inner tubular piston slideably positioned within said piston sealing ring, said tubular piston have an upper sealing flange creating an upper fluid chamber in said outer tubular housing between said upper sealing flange and said stationary piston and a lower fluid chamber between said lower sealing flange and said stationary piston;

(d) an upper fluid conduit in said stationary piston sealing ring in fluid communication with said upper fluid chamber and a lower fluid conduit in said stationary piston in fluid communication with said lower fluid chamber;

(e) a first fluid line in communication with said upper fluid conduit and a second fluid line in communication with said lower fluid conduit whereby pressurized fluid may be selectively directed;

(f) a pump providing fluid to said first and said second fluid lines;

(g) a directional valve whereby fluid flow to said first and said second fluid lines may be selectively directed to said upper and lower fluid conduits whereby said fluid moves said inner tubular piston upward and downward within said outer tubular housing as desired;

(h) a bearing table mounted on said upper end of said inner tubular piston;

(i) travelling slips attached to said bearing table; and (j) a pipe extending through said inner tubular piston whereby said pipe may be gripped and released by said traveling slips thereby moving said pipe upward and downward with said upward and downward movement of said inner tubular cylinder.

13. The cylinder assembly as recited in claim 12 wherein said top end of said outer tubular housing has an attachment flange, said top end attachment flange mounted to the floor of a drilling rig below stationary slips positioned above an opening to a wellbore.

14. The cylinder assembly as recited in claim 12 further comprising:

(a) stationary slips mounted on a BOP Stack positioned over a wellbore;

(b) an attachment flange on said base end of said outer tubular housing, said base end attachment flange mounted to said stationary slips above said wellbore; and (c) a tubular spool attached to said upper end of said inner tubular piston.

15. The cylinder assembly as recited in claim 14 further comprising a tubular pipe guide positioned within said outer tubular housing.

16. A method of snubbing a pipe through a BOP stack of a wellbore comprising the steps of:

(a) providing a snubbing cylinder having an outer cylindrical tubular housing, a stationary piston sealing ring retained within said outer housing, said stationary piston sealing ring separating said outer housing into upper and lower outer housing segments, an inner tubular piston slideably positioned within said piston sealing ring, said tubular piston have an upper sealing end and a lower sealing end creating an upper fluid chamber in said upper housing segment and a lower fluid chamber in said lower housing segment;

(b) attaching a bearing table to said upper sealing end of said tubular piston;

(c) attaching a set of travelling slips to said bearing table;

(d) providing stationary slips mounted to a BOP stack positioned over a wellbore containing a pipe string;

(e) attaching said pipe string to said stationary slips;

(f) moving said piston upward through said outer cylindrical housing by introducing pressurized fluid into said upper fluid chamber;

(g) positioning a pipe segment through said inner tubular piston;

(h) attaching said pipe segment to said travelling slips;

(i) moving said inner tubular piston downward through said outer cylindrical housing by introducing pressurized fluid into said lower fluid chamber whereby said pipe segment is positioned for attachment to said pipe string;

(j) rotating said pipe segment whereby said pipe segment and said pipe string are attached;

(k) detaching said stationary slips from said pipe string; and (l) moving said inner tubular piston further downward through said outer cylindrical housing by introducing pressurized fluid into said lower fluid chamber thereby pushing said pipe segment with said attached pipe string through said BOP stack.

17. The method of snubbing a pipe recited in claim 16 wherein said step of rotating said pipe segment includes rotating said pipe segment with a top drive.

18. A snubbing unit comprising:

(a) an outer tubular housing defined by upper and lower outer tubular cylinders, said lower outer tubular cylinder attached to stationary slips mounted on a BOP stack positioned over a wellbore;

(b) a stationary piston sealing ring separating said upper and lower outer tubular to cylinders;

(c) an inner tubular piston having an upper sealing end, a lower sealing end, and a central bore for receiving a length of pipe, said inner tubular piston slideably received in said piston sealing ring;

(d) an upper annular fluid chamber defined by said stationary piston, said inner tubular piston, and said upper outer tubular cylinder and a lower annular fluid chamber defined by said stationary piston, said inner tubular piston, and said lower outer tubular cylinder;

(e) fluid conduits in said piston sealing ring in communication with said upper and lower annular fluid chambers;

(f) fluid selectively directed into said upper annular fluid chamber or said lower fluid annular chamber through said fluid conduits whereby said inner tubular piston may be selectively moved upward or downward;

(g) a pipe guide positioned within said lower outer tubular cylinder;

(h) a tubular spool having an upper end and a lower end, said lower end of said tubular spool attached to said upper sealing end of said inner tubular piston;

(i) a bearing table positioned on said upper end of said tubular spool, said bearing table having a central opening; and (j) travelling slips mounted to said bearing table whereby a length of pipe may be supported to extend vertically through said central opening of said bearing table and said inner tubular piston.

19. The snubbing unit recited in claim 18 further comprising a top drive whereby to said length of pipe may be rotated.

20. The snubbing unit recited in claim 18 wherein said bearing table is a powered rotary table whereby said length of pipe may be rotated.

* * * * *